US011459079B2

(12) United States Patent
Kimpara

(10) Patent No.: US 11,459,079 B2
(45) Date of Patent: Oct. 4, 2022

(54) SHIP PROPULSION MACHINE

(71) Applicant: SUZUKI MOTOR CORPORATION, Hamamatsu (JP)

(72) Inventor: Masatoshi Kimpara, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 34 days.

(21) Appl. No.: 17/224,844

(22) Filed: Apr. 7, 2021

(65) Prior Publication Data

US 2021/0316834 A1 Oct. 14, 2021

(30) Foreign Application Priority Data

Apr. 14, 2020 (JP) ..... JP2020-072403

(51) Int. Cl.
*B63H 23/06* (2006.01)
*B63H 23/32* (2006.01)

(52) U.S. Cl.
CPC ..... *B63H 23/06* (2013.01); *B63H 23/321* (2013.01)

(58) Field of Classification Search
CPC ..... B63H 23/06; B63H 23/32; B63H 23/321; B63H 2020/006; B63H 5/10; B63H 2005/106
USPC ..... 440/75, 76, 78, 79, 83
See application file for complete search history.

(56) References Cited

U.S. PATENT DOCUMENTS 8,157,694 B2 * 4/2012 Nakamura ..... B63H 5/10 440/86
8,246,402 B2 * 8/2012 Okabe ..... B63H 23/30 440/75

FOREIGN PATENT DOCUMENTS

JP A-H09-024896 1/1997

* cited by examiner

*Primary Examiner* — Daniel V Venne
(74) *Attorney, Agent, or Firm* — Stein IP, LLC

(57) ABSTRACT

There is provided a ship propulsion machine including: a drive shaft; a drive gear fixed to the drive shaft; a front gear meshed with the drive gear; a rear gear meshed with the drive gear; a rear propeller provided on an inner propeller shaft; a front propeller provided on an outer propeller shaft; a casing having a gear chamber; a second bearing that supports a front end side of the outer propeller shaft at a rear portion of the casing; a third bearing that supports the inner propeller shaft and the outer propeller shaft in a manner rotatable with respect to each other. The third bearing is disposed on an inner peripheral side of a shaft portion of the rear gear, and the second bearing is disposed on an outer peripheral side of the shaft portion of the rear gear.

5 Claims, 3 Drawing Sheets

SHIP PROPULSION MACHINE

CROSS-REFERENCE TO RELATED APPLICATIONS

This application is based on Japanese Patent Application No. 2020-072403 filed on Apr. 14, 2020, the contents of which are incorporated herein by way of reference.

TECHNICAL FIELD

The present invention relates to a ship propulsion machine such as an outboard motor or an inboard/outboard motor.

BACKGROUND

A ship propulsion machine having a contra-rotating propeller that includes two propellers arranged coaxially and that rotates the propellers in opposite directions, is known. Patent Literature 1 listed below discloses a propulsion device for a ship equipped with a contra-rotating propeller.

The propulsion device illustrated in FIG. 1 of Patent Literature 1 is provided with an intermediate shaft (2) extending in a vertical direction, and an upper end side of the intermediate shaft (2) is connected to a power source. A bevel gear (4) is provided at a lower end side of the intermediate shaft (2). The propulsion device is provided with an inner propeller shaft (7) and an outer propeller shaft (8) that extend in a horizontal direction. The outer propeller shaft (8) is formed in a hollow shape, and is disposed on an outer peripheral side of the inner propeller shaft (7) in a manner concentric with the inner propeller shaft (7). In the inner propeller shaft (7), a rear propeller (14) is provided at a rear end side, and a bevel gear (5) is provided at a front end side. The bevel gear (5) meshes with the bevel gear (4) provided at the lower end side of the intermediate shaft (2). In the outer propeller shaft (8), a front propeller (13) is provided at a rear end side, and a bevel gear (6) is provided at a front end side. The bevel gear (6) meshes with the bevel gear (4). A front end side of the inner propeller shaft (7) is supported by a casing (1) of the propulsion device via a rolling bearing (11). A front end side of the outer propeller shaft (8) is supported by a casing (1) of the propulsion device via a rolling bearing (12). Two contra-rotating bearings (9, 10) are provided between the inner propeller shaft (7) and the outer propeller shaft (8).

Patent Literature 1: JP-A-H09-024896

A ship propulsion machine equipped with a contra-rotating propeller requires a structure for rotatably supporting two coaxially arranged propeller shafts on a casing side of the ship propulsion machine via bearings, and thus the structure is likely to be complicated. Therefore, it is not easy to reduce a size of a ship propulsion machine equipped with a contra-rotating propeller.

In this regard, in the propulsion device illustrated in FIG. 1 of Patent Literature 1, the front end side of the outer propeller shaft (8) is supported by a rear wall of the casing (1) via the rolling bearing (12). A foremost end portion of the outer propeller shaft (8) enters the casing (1) and is coupled to the bevel gear (6) disposed in the casing (1). In this propulsion device, as described above, respective positions of the rolling bearing (12) and the bevel gear (6) are different from each other in an extension direction of the outer propeller shaft (8) and are separated from each other. Therefore, a length of the outer propeller shaft (8) is elongated by a separation distance between the rolling bearing (12) and the bevel gear (6). Therefore, in the propulsion device, it is difficult to shorten the length of the outer propeller shaft (8), and it is difficult to reduce the size of the propulsion device.

The present invention has been made in view of the above-described problems, and an object of the present invention is to provide a ship propulsion machine that can be reduced in size even when a contra-rotating propeller is employed.

SUMMARY

In order to solve the above problem, there is provided a ship propulsion machine including: a drive shaft extending in an upper-down direction and configured to rotate based on power of a power source; a drive gear fixed to a lower end side of the drive shaft; an inner propeller shaft extending in a front-back direction; an outer propeller shaft formed in a tubular shape and arranged on an outer peripheral side of the inner propeller shaft in a manner coaxial with the inner propeller shaft; a front gear fixed to a front end side of the inner propeller shaft and meshed with the drive gear at a position forward of the drive shaft; a rear gear fixed to a front end side of the outer propeller shaft and meshed with the drive gear at a position rearward of the drive shaft; a rear propeller provided on the inner propeller shaft; a front propeller provided on the outer propeller shaft; a casing having a gear chamber in which the lower end side of the drive shaft, the front end side of the inner propeller shaft, and the front end side of the outer propeller shaft are inserted, and in which the drive gear, the front gear, and the rear gear are accommodated; a first bearing that rotatably supports the front end side of the inner propeller shaft at a front portion of the casing; a second bearing that rotatably supports the front end side of the outer propeller shaft at a rear portion of the casing; a third bearing that supports the inner propeller shaft and the outer propeller shaft in a manner rotatable with respect to each other; and a fourth bearing that supports the inner propeller shaft and the outer propeller shaft in a manner rotatable with respect to each other at a position rearward of the third bearing. The third bearing is disposed on an inner peripheral side of a shaft portion of the rear gear, and the second bearing is disposed on an outer peripheral side of the shaft portion of the rear gear.

DESCRIPTION OF EMBODIMENTS

Figure 1:
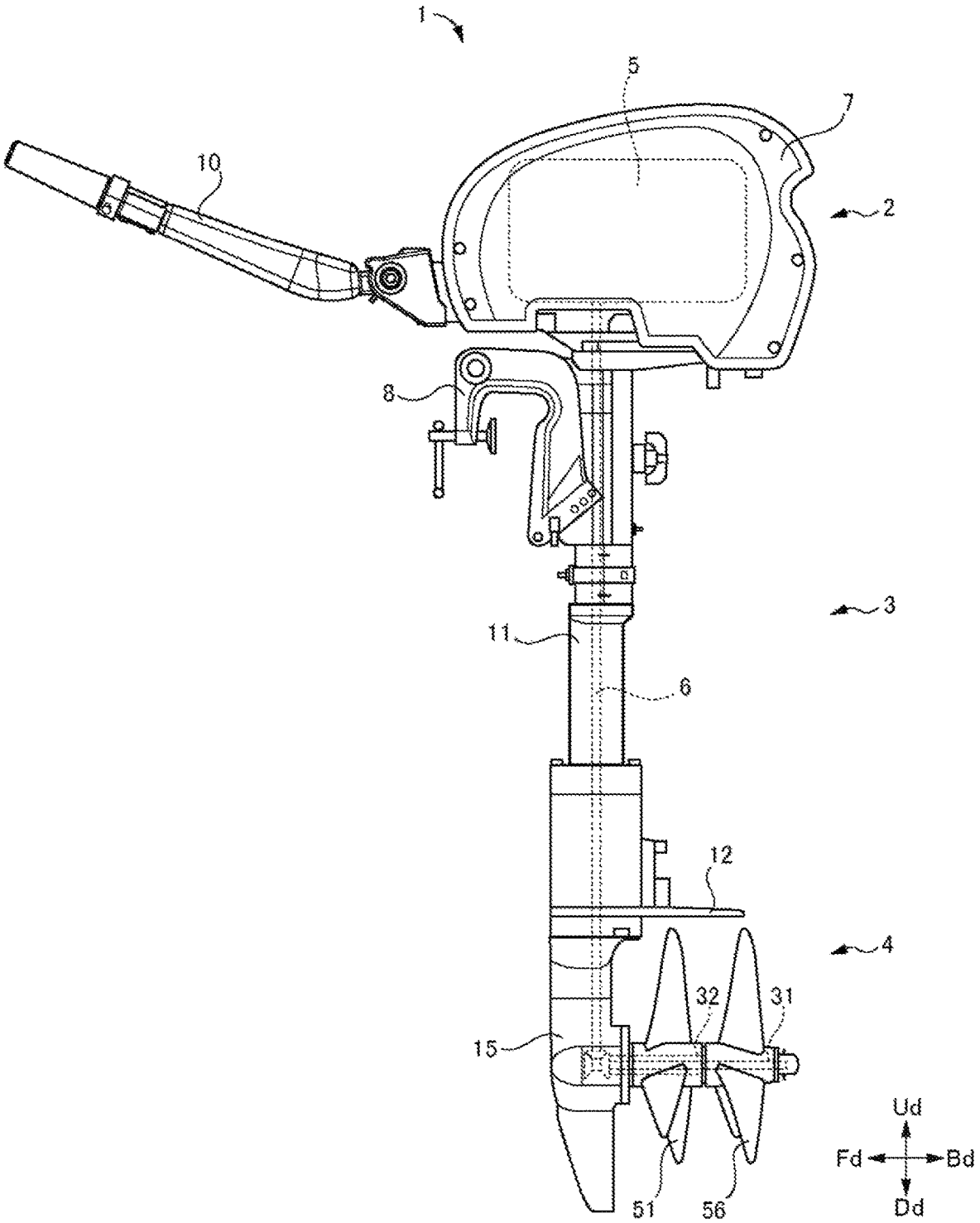
FIG. 1 is an external view showing an entire outboard motor that is an embodiment of a ship propulsion machine according to the present invention.

A ship propulsion machine according to an embodiment of the present invention includes a drive shaft, a drive gear, an inner propeller shaft, an outer propeller shaft, a front gear, a rear gear, a rear propeller, and a front propeller. The drive shaft extends in an upper-down direction and rotates based on power of a power source. The drive gear is fixed to a lower end side of the drive shaft and rotates together with the drive shaft. The inner propeller shaft is a rotary shaft of the rear propeller and extends in the front-back direction. The outer propeller shaft is a rotary shaft of the front propeller. The outer propeller shaft is formed in a tubular shape and arranged on an outer peripheral side of the inner propeller shaft in a manner coaxial with the inner propeller shaft. The front gear is fixed to a front end side of the inner propeller shaft and rotates together with the inner propeller shaft. The front gear meshed with the drive gear at a position forward of the drive shaft. The rear gear is fixed to a front end side of the outer propeller shaft and rotates together with the outer propeller shaft. The rear gear meshed with the drive gear at a position rearward of the drive shaft. The rear propeller is fixed to a rear end portion of the inner propeller shaft. The front propeller is fixed to the outer propeller shaft.

Further, the ship propulsion machine according to the embodiment of the present invention includes a casing having a gear chamber in which the lower end side of the drive shaft, the front end side of the inner propeller shaft, and the front end side of the outer propeller shaft are inserted, and in which the drive gear, the front gear, and the rear gear are accommodated.

Further, the ship propulsion machine according to the embodiment of the present invention includes four bearings. A first bearing rotatably supports the front end side of the inner propeller shaft at a front portion of the casing. A second bearing rotatably supports the front end side of the outer propeller shaft at a rear portion of the casing. A third bearing supports the inner propeller shaft and the outer propeller shaft in a manner rotatable with respect to each other. A fourth bearing supports the inner propeller shaft and the outer propeller shaft in a manner rotatable with respect to each other at a position rearward of the third bearing. The third bearing is disposed on an inner peripheral side of a shaft portion of the rear gear, and the second bearing is disposed on an outer peripheral side of the shaft portion of the rear gear.

In the ship propulsion machine according to the present embodiment, the second bearing is disposed on the outer peripheral side of the shaft portion of the rear gear. According to this configuration, the position of the rear gear and the position of the second bearing can coincide with each other in the extension direction of the outer propeller shaft. Further, the third bearing is disposed on the inner peripheral side of the shaft portion of the rear gear. According to this configuration, the position of the rear gear and the position of the third bearing can coincide with each other in the extension direction of the outer propeller shaft. Therefore, according to the ship propulsion machine of the present embodiment, it is possible to shorten the length of the outer propeller shaft as compared with a configuration in which the position of the rear gear and the position of the second bearing are different in the extension direction of the outer propeller shaft or a configuration in which the position of the rear gear and the position of the third bearing are different in the extension direction of the outer propeller shaft. By shortening the length of the outer propeller shaft, it is possible to shorten the length of the inner propeller shaft as well. Therefore, the size of the ship propulsion machine in the front-back direction can be reduced, and the ship propulsion machine can be reduced in size.

Embodiment

An outboard motor 1 that is an embodiment of the ship propulsion machine according to the present invention will be described with reference to the drawings. In the description on the present embodiment, front (Fd), back (Bd), upper (Ud), down (Dd) directions follow arrows drawn at a lower right portion of each drawing.

FIG. 1 shows the entire outboard motor 1. The outboard motor 1 includes an upper unit 2, a middle unit 3, and a lower unit 4. The upper unit 2 is provided with an electric motor 5 as a power source of the outboard motor 1. The electric motor 5 is connected with a drive shaft 6 for transmitting power of the electric motor 5 to an inner propeller shaft 31 and an outer propeller shaft 32 provided in the lower unit 4. The drive shaft 6 extends in the upper-down direction from the upper unit 2 to the lower unit 4. The upper unit 2 is provided with a cowling 7 for covering the electric motor 5, a clamp bracket 8 for fixing the outboard motor 1 to a hull, a swivel bracket for tilting the outboard motor 1 in the upper-down direction, and a tiller bar handle 10 for maneuvering a ship.

The middle unit 3 is provided with a shaft casing 11 that covers the drive shaft 6, an anti-ventilation plate 12, and the like.

The lower unit 4 is provided with a gear casing 15 in which gears described later are accommodated. The lower unit 4 is provided with the inner propeller shaft 31 and the outer propeller shaft 32. The inner propeller shaft 31 and the outer propeller shaft 32 extend in the front-back direction. The outer propeller shaft 32 is provided with a front propeller 51, and the inner propeller shaft 31 is provided with a rear propeller 56.

Figure 2:
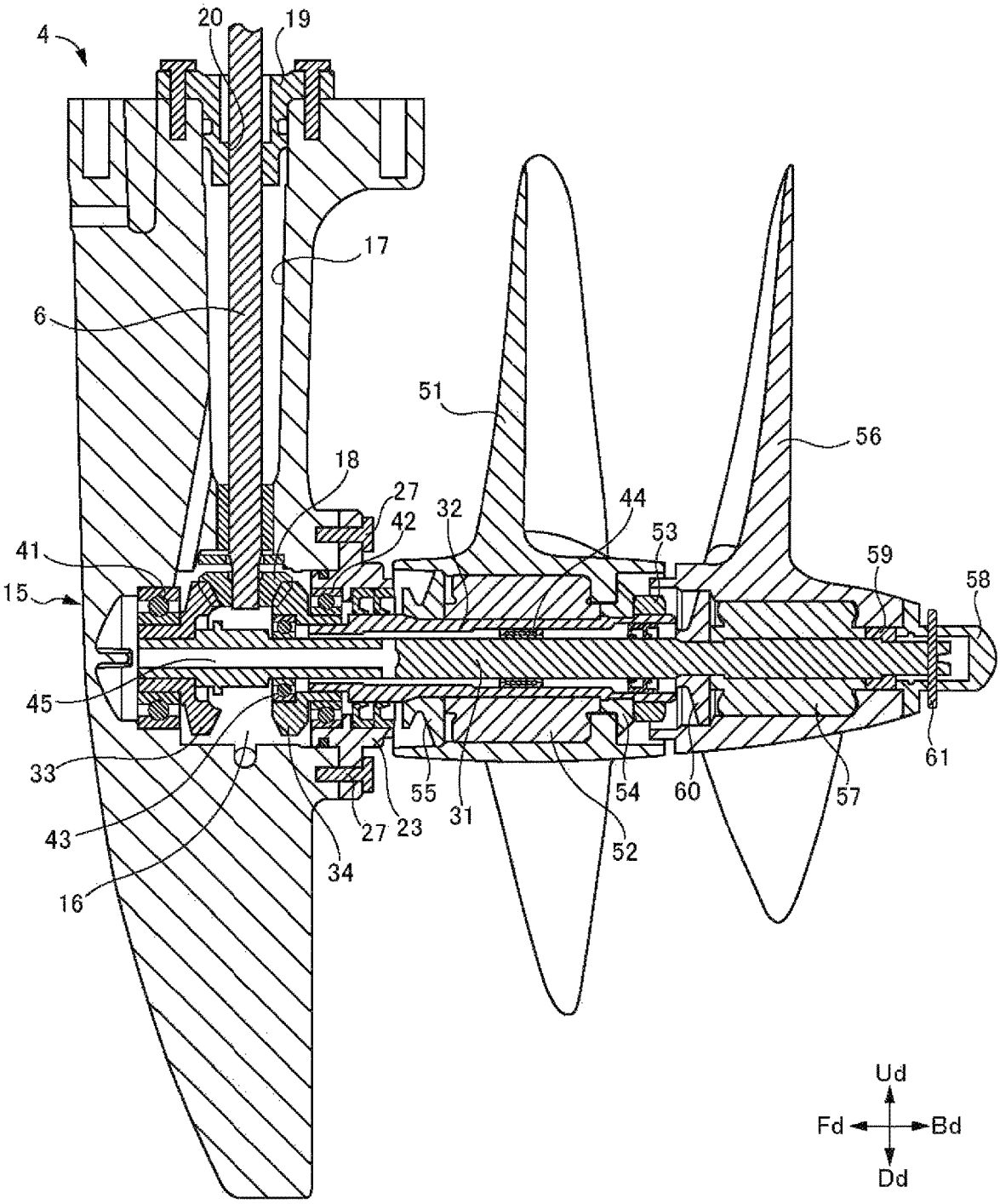
FIG. 2 is a cross-sectional view showing an internal structure of a lower unit in the outboard motor according to the embodiment of the present invention.
Figure 3:
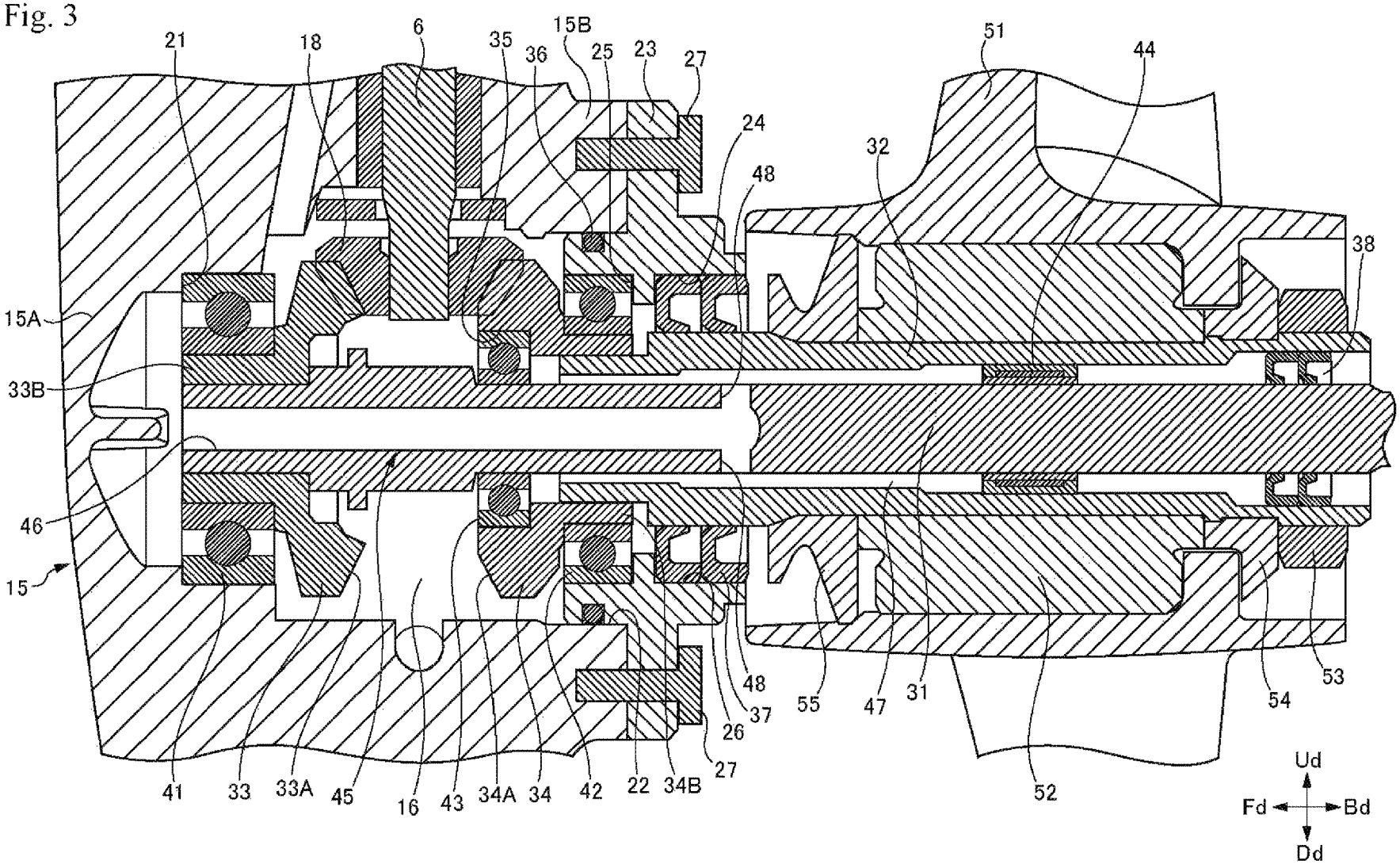
FIG. 3 is an enlarged cross-sectional view showing a gear chamber and a peripheral portion thereof in the internal structure of the lower unit in FIG. 2.

FIG. 2 shows a detailed internal structure of the lower unit 4. FIG. 3 is an enlarged view of the gear chamber 16 and a peripheral portion thereof in FIG. 2. As shown in FIG. 2, a gear chamber 16 for accommodating gears is provided at a substantially central portion of the gear casing 15. In the gear casing 15, a drive shaft insertion hole 17 into which the drive shaft 6 is inserted is provided in a portion from an upper portion of the gear casing 15 to the gear chamber 16, and a lower end side of the drive shaft insertion hole 17 communicates with an inside of the gear chamber 16.

A lower end portion of the drive shaft 6 is inserted into the drive shaft insertion hole 17. A drive gear 18 is fixed to a lowermost end portion of the drive shaft 6. The drive gear 18 rotates together with the drive shaft 6. The drive gear 18 is a bevel gear and is disposed in the gear chamber 16. An upper end portion of the drive shaft insertion hole 17 is provided with a lid 19 for closing the drive shaft insertion hole 17. The drive shaft 6 enters the drive shaft insertion hole 17 through a through hole 20 provided in the lid 19.

As shown in FIG. 3, a portion of a front portion 15A of the gear casing 15 corresponding to the gear chamber 16 is provided with a bearing support portion 21 that is a step portion supporting an outer ring of a first bearing 41.

As shown in FIG. 3, a portion of a rear portion 15B of the gear casing 15 corresponding to the gear chamber 16 is provided with a component insertion hole 22 that allows an outside of the gear casing 15 and an inside of the gear chamber 16 to communicate with each other. A cover member 23 that covers the component insertion hole 22 from behind is detachably provided in the portion of the rear portion 15B of the gear casing 15 corresponding to the gear chamber 16. The component insertion hole 22 has a diameter larger than an outer diameter of any of the components inserted or accommodated in the gear chamber 16, specifically, the inner propeller shaft 31, the outer propeller shaft 32, the front gear 33, the rear gear 34, the first bearing 41, a second bearing 42, and a third bearing 43. Upon assembly of the outboard motor 1, in a state where the cover member 23 is not attached to the gear casing 15, these components can be inserted into the gear chamber 16 through the component insertion hole 22. Further, the cover member 23 is provided with a propeller shaft insertion hole 24 into which the inner propeller shaft 31 and the outer propeller shaft 32 are inserted. A front portion of the cover member 23 is provided with a bearing support portion 25 that is a step portion supporting an outer ring of the third bearing 43. A seal member mounting portion 26 for mounting the seal member 37 is provided at a rear portion of the cover member 23. The cover member 23 is attached to the rear portion 15B of the gear casing 15 by using a fixing member 27 such as a bolt.

The lower unit 4 is also provided with the inner propeller shaft 31, which is a rotary shaft of the rear propeller 56, and the outer propeller shaft 32, which is a rotary shaft of the front propeller 51. The inner propeller shaft 31 and the outer propeller shaft 32 extend in the front-back direction, which is a direction orthogonal to the drive shaft 6. The outer propeller shaft 32 is formed in a tubular shape and arranged on an outer peripheral side of the inner propeller shaft 31 in a manner coaxial with the inner propeller shaft 31. An inner diameter of the outer propeller shaft 32 is larger than an outer diameter of the inner propeller shaft 31, and a space is formed between an inner peripheral surface of the outer propeller shaft 32 and an outer peripheral surface of the inner propeller shaft 31.

A front end portion of the inner propeller shaft 31 enters the gear chamber 16 from the rear of the gear casing 15 through the propeller shaft insertion hole 24 of the cover member 23 and the component insertion hole 22, and passes below the drive gear 18 to reach a deep side (front side) in the gear chamber 16. A front gear 33 is fixed to a foremost end portion of the inner propeller shaft 31. The front gear 33 rotates together with the inner propeller shaft 31. The front gear 33 is a bevel gear and disposed in the gear chamber 16, and meshes with the drive gear 18 at a position forward of the drive shaft 6. Teeth 33A are provided on an outer peripheral portion of a rear portion of the front gear 33. A shaft portion (inner peripheral portion) of the front gear 33 projects forward, and a front portion of the projecting shaft portion serves as a boss 33B.

A front end portion of the outer propeller shaft 32 enters the gear chamber 16 from the rear of the gear casing 15 through the propeller shaft insertion hole 24 of the cover member 23 and the component insertion hole 22, but stops at a shallow side (rear side) in the gear chamber 16. A rear gear 34 is fixed to a foremost end portion of the outer propeller shaft 32. The rear gear 34 rotates together with the outer propeller shaft 32. The rear gear 34 is a bevel gear and disposed in the gear chamber 16, and meshes with the drive gear 18 at a position rearward of the drive shaft 6. The front gear 33 and the rear gear 34 face each other in the front-back direction. Teeth 34A are provided on an outer peripheral portion of a front portion of the rear gear 34. A bearing support portion 35 for accommodating and supporting an outer ring of the third bearing 43 is provided in a shaft portion (inner peripheral portion) of the front portion of the rear gear 34. That is, a hole penetrating in the axial direction is provided in the rear gear 34, and a diameter of a front portion of the hole is larger than a diameter of a rear portion of the hole. A portion where the diameter of the front portion of the hole is increased is the bearing support portion 35. A shaft portion of the rear gear 34 protrudes rearward, and a rear portion of the protruding shaft portion serves as a boss 34B.

Further, the lower unit 4 is provided with four bearings 41 to 44. The first bearing 41 rotatably supports a front end side of the inner propeller shaft 31 at the front portion 15A of the gear casing 15. The first bearing 41 is, for example, a ball bearing or a roller bearing. The first bearing 41 is disposed between the foremost end portion of the inner propeller shaft 31 and a front portion of the gear casing 15. Specifically, the first bearing 41 is disposed on an outer peripheral side of the boss 33B of the front gear 33 fixed to the foremost end portion of the inner propeller shaft 31. More specifically, an inner ring of the first bearing 41 is disposed on the outer peripheral side of the boss 33B of the front gear 33, and an outer ring of the first bearing 41 is disposed in the bearing support portion 21 of the gear casing 15.

The second bearing 42 rotatably supports a front end side of the outer propeller shaft 32 at the rear portion 15B of the gear casing 15. The second bearing 42 is, for example, a ball bearing or a roller bearing. The second bearing 42 is disposed between the foremost end portion of the outer propeller shaft 32 and a rear portion of the gear casing 15. Specifically, the second bearing 42 is disposed on an outer peripheral side of the boss 34B of the rear gear 34 fixed to the foremost end portion of the outer propeller shaft 32. More specifically, an inner ring of the second bearing 42 is disposed on the outer peripheral side of the boss 34B of the rear gear 34, and an outer ring of the second bearing 42 is disposed in the bearing support portion 25 of the cover member 23 attached to the gear casing 15.

The third bearing 43 supports the inner propeller shaft 31 and the outer propeller shaft 32 in a manner rotatable with respect to each other. The third bearing 43 is, for example, a ball bearing or a roller bearing. The third bearing 43 is disposed between the rear gear 34 fixed to the foremost end portion of the outer propeller shaft 32 and the inner propeller shaft 31. Specifically, the third bearing 43 is disposed on the inner peripheral side of the shaft portion of the rear gear 34. More specifically, an inner ring of the third bearing 43 is disposed on a portion of the front end portion of the inner propeller shaft 31 corresponding, in the front-back direction, to a portion where the teeth of the rear gear 34 are provided, and an outer ring of the third bearing 43 is disposed in the bearing support portion 35 of the rear gear 34.

The fourth bearing 44 supports the inner propeller shaft 31 and the outer propeller shaft 32 in a manner rotatable with respect to each other at a position rearward of the third bearing 43. The fourth bearing 44 is, for example, a needle bearing. The fourth bearing 44 is located outside the gear chamber 16, and is disposed between the inner propeller shaft 31 and the outer propeller shaft 32. A position of the fourth bearing 44 in the front-back direction coincides with a position of a substantially central portion of the inner propeller shaft 31 in the front-back direction, a position of a substantially central portion of the outer propeller shaft 32 in the front-back direction, or a position of a substantially central portion of the front propeller 51 in the front-back direction.

Further, among the four bearings 41 to 44, a size and an allowable thrust load of each of the first bearing 41 and the second bearing 42 are larger than a size and an allowable thrust load of each of the third bearing 43 and the fourth bearing 44 (the fourth bearing 44 is a needle bearing, and thus has a very small allowable thrust load). Further, in the present embodiment, the size and the allowable thrust load of the first bearing 41 are larger than the size and the allowable thrust load of the second bearing 42.

A seal member 36 for sealing between the cover member 23 and the gear casing 15 is provided on an outer peripheral side of the front portion of the cover member 23 in order to prevent water from entering the gear chamber 16 through the component insertion hole 22. Further, a seal member 37 for sealing between the cover member 23 and the outer propeller shaft 32 is provided on the seal member mounting portion 26 of the cover member 23 in order to prevent water from entering the gear chamber 16 through the propeller shaft insertion hole 24. A seal member 38 for sealing between the rear end portion of the outer propeller shaft 32 and inner propeller shaft 31 is provided between the rear end portion of the outer propeller shaft 32 and the inner propeller shaft 31 in order to prevent water from entering the gear chamber 16 through an inside of the outer propeller shaft 32.

The inner propeller shaft 31 is provided with a lubricating oil passage 45 through which lubricating oil in the gear chamber 16 is to be supplied to the fourth bearing 44. The lubricating oil passage 45 includes a central hole 46 provided in an axial center portion of a rear end portion of the inner propeller shaft 31, an internal space 47 provided between the outer propeller shaft 32 and the inner propeller shaft 31, and communication holes 48 provided in the inner propeller shaft 31 and communicating between the central hole 46 and the internal space 47. The central hole 46 communicates with the inside of the gear chamber 16 at a rearmost end portion of the inner propeller shaft 31. The central hole 46 extends forward from the rearmost end portion of the inner propeller shaft 31 to a portion of the inner propeller shaft 31 that enters the inside of the outer propeller shaft 32 (in the present embodiment, a portion immediately after coming out of the gear chamber 16). A plurality of communication holes 48 are provided in a portion of the inner propeller shaft 31 that enters the inside of the outer propeller shaft 32 so as to extend in the radial direction, and connect the central hole 46 and the internal space 47.

Lubricating oil is stored in the gear chamber 16. During operation of the outboard motor 1, the lubricating oil in the gear chamber 16 is stirred by the front gear 33, the rear gear 34, and the like. As a result, the lubricating oil in the gear chamber 16 is supplied to the drive gear 18, the front gear 33, the rear gear 34, the first bearing 41, the second bearing 42, the third bearing 43, and the like that are provided in the gear chamber 16, and lubricates these components. Further, the lubricating oil in the gear chamber 16 flows into the internal space 47 through the central hole 46 and the communication holes 48, and is supplied to the fourth bearing 44 disposed in the internal space 47 to lubricate the fourth bearing 44.

As shown in FIG. 2, the front propeller 51 is provided on the outer peripheral side of the outer propeller shaft 32 via a support member 52 including a bush, a damper, and the like. The front propeller 51 is fixed to the outer propeller shaft 32 by a nut 53, a spacer 54, and a stopper 55, and rotates together with the outer propeller shaft 32. Specifically, the stopper 55 is attached to the outer propeller shaft 32 so as not to move rearward of a predetermined position illustrated in FIG. 2. The nut 53 is fastened to the rear end portion of the outer propeller shaft 32. A hub of the front propeller 51 is fixed between the stopper 55 and the nut 53 via the spacer 54.

The rear propeller 56 is provided on the outer peripheral side of the rear end side portion of the inner propeller shaft 31 via a support member 57 including a bush, a damper, and the like. The rear propeller 56 is disposed behind the front propeller 51. The rear propeller 56 is fixed to the inner propeller shaft 31 by a nut 58, a spacer 59, and a stopper 60, and rotates together with the inner propeller shaft 31. Specifically, the stopper 60 is attached to the inner propeller shaft 31 so as not to move rearward of a predetermined position illustrated in FIG. 2. The nut 58 is fixed to the rear end portion of the inner propeller shaft 31 via a cotter pin 61. A hub of the rear propeller 56 is fixed between the stopper 60 and the nut 58 via the spacer 59.

When the hull to which the outboard motor 1 is attached is to move forward, for example, the electric motor is rotated forward. Since the drive gear 18 constantly meshes with both the front gear 33 and the rear gear 34, when the electric motor rotates forward, power thereof is transmitted to the drive gear 18 via the drive shaft 6, and is transmitted from the drive gear 18 to the rear gear 34 and the front gear 33 simultaneously. As a result, the outer propeller shaft 32 and the front propeller 51 rotate in one direction, and simultaneously, the inner propeller shaft 31 and the rear propeller 56 rotate in the other direction. On the other hand, when the hull is to move rearward, for example, the electric motor is rotated backward. As a result, the outer propeller shaft 32 and the front propeller 51 rotate in the other direction, and simultaneously, the inner propeller shaft 31 and the rear propeller 56 rotate in the one direction.

As described above, the outboard motor 1 of the embodiment of the present invention includes: the second bearing 42 that rotatably supports the front end side of the outer propeller shaft 32 on the rear portion 15B of the gear casing 15; and the third bearing 43 that supports the inner propeller shaft 31 and the outer propeller shaft 32 in a manner rotatable with respect to each other. The second bearing 42 is disposed on the outer peripheral side of the boss 34B of the rear gear 34. The third bearing 43 is disposed on the inner peripheral side of the shaft portion of the rear gear 34. According to this configuration, in the extension direction of the outer propeller shaft 32, the position of the second bearing 42 and the position of the rear gear 34 can coincide with each other, and the position of the third bearing 43 and the position of the rear gear 34 can coincide with each other. Therefore, it is possible to shorten the length of the outer propeller shaft 32 as compared with a configuration in which the position of the second bearing 42 and the position of the rear gear 34 are different in the extension direction of the outer propeller shaft 32 or a configuration in which the position of the third bearing 43 and the position of the rear gear 34 are different in the extension direction of the outer propeller shaft 32. By shortening the length of the outer propeller shaft 32, it is possible to shorten the length of the inner propeller shaft 31 as well, and as a result, the size of the outboard motor 1 in the front-back direction can be reduced, and the outboard motor 1 can be reduced in size.

In the outboard motor 1 of the present embodiment, the first bearing 41 that rotatably supports the front end side of the inner propeller shaft 31 on the front portion 15A of the gear casing 15 is disposed on the outer peripheral side of the boss 33B of the front gear 33. According to this configuration, the position of the first bearing 41 and the position of the front gear 33 can coincide with each other in the extension direction of the inner propeller shaft 31. Therefore, compared to a configuration in which the position of the first bearing 41 and the position of the front gear 33 are different from each other in the extension direction of the inner propeller shaft 31, the length of the inner propeller shaft 31 can be shortened, and the outboard motor 1 can be further reduced in size.

The outboard motor 1 of the present embodiment includes the fourth bearing 44 that supports the inner propeller shaft 31 and the outer propeller shaft 32 in a manner rotatable with respect to each other at a substantially central portion of the inner propeller shaft 31 or the outer propeller shaft 32 in the front-back direction, and a needle bearing is used as the fourth bearing 44. The needle bearing has a smaller difference between the inner diameter and the outer diameter than a ball bearing or a roller bearing. By using a needle bearing as the fourth bearing 44, the distance between the outer peripheral surface of the inner propeller shaft 31 and the inner peripheral surface of the outer propeller shaft 32 can be reduced. Therefore, the diameter of the outer propeller shaft 32 can be reduced, and the outboard motor 1 can be reduced in size.

Further, the outboard motor 1 of the present embodiment includes the lubricating oil passage 45 that supplies the lubricating oil in the gear chamber 16 to the fourth bearing 44. The lubricating oil passage 45 has a configuration in which the lubricating oil in the gear chamber 16 is supplied to the internal space 47 between the outer propeller shaft 32 and the inner propeller shaft 31 via the central hole 46 and the communication holes 48 provided in the inner propeller shaft 31, so as to lubricate the fourth bearing 44 disposed in the internal space 47. According to this configuration, since the path through which the lubricating oil moves from the inside of the gear chamber 16 to the internal space 47 is formed inside the inner propeller shaft 31, it is possible to form a structure for lubricating the fourth bearing 44 without increasing the size of the outboard motor 1.

In the outboard motor 1 of the present embodiment, the inner propeller shaft 31 and the outer propeller shaft 32 are rotatably supported by a small number of bearings, that is, the four bearings 41 to 44. According to this configuration, the support structure of the two propeller shafts 31 and 32 can be simplified, and the number of components can be reduced.

The first bearing 41 has a largest size and has a largest allowable thrust load among the four bearings 41 to 44. In the outboard motor 1 of the present embodiment, a forward thrust load applied to the outboard motor 1 when the hull moves forward is finally concentrated on the first bearing 41. That is, when the hull moves forward, a thrust load is transmitted to the front propeller 51, the stopper 55, the outer propeller shaft 32, the rear gear 34, the third bearing 43, the inner propeller shaft 31, and the front gear 33 in this order, and is applied to the first bearing 41. Simultaneously, when the hull moves forward, a thrust load is transmitted to the rear propeller 56, the stopper 60, the inner propeller shaft 31, and the front gear 33 in this order, and is applied to the first bearing 41. According to the present embodiment, since the first bearing 41 has an increased size and an increased allowable thrust load, durability of the first bearing 41 with respect to such thrust load can be sufficiently ensured.

The second bearing 42 has a largest size second to that of the first bearing 41 among the four bearings 41 to 44, and has a largest allowable thrust load second to the allowable thrust load of the first bearing 41. In the outboard motor 1 of the present embodiment, a rearward thrust load applied to the outboard motor 1 when the hull moves rearward is finally concentrated on the second bearing 42. That is, when the hull moves rearward, a thrust load is transmitted to the front propeller 51, the spacer 54, the nut 53, the outer propeller shaft 32, and the rear gear 34 in this order, and is applied to the second bearing 42. Simultaneously, when the hull moves rearward, a thrust load is transmitted to the rear propeller 56, the spacer 59, the nut 58, the inner propeller shaft 31, the third bearing 43, and the rear gear 34 in this order, and is applied to the second bearing 42. According to the present embodiment, since the second bearing 42 has an increased size and an increased allowable thrust load, durability of the second bearing 42 with respect to such thrust load can be sufficiently ensured.

Further, since it is considered that the thrust load applied to the outboard motor 1 is larger when the hull moves forward than when the hull moves rearward, the bearing having the largest size and the largest allowable thrust load among the four bearings 41 to 44 is selected as the first bearing 41, and the bearing having the second largest size and the allowable thrust load is selected as the second bearing 42.

Further, in the outboard motor 1 of the present embodiment, the electric motor 5, which has a large torque in a low rotation range as compared with an internal combustion engine, is used as the power source, and a propeller having a large diameter is used as each of the front propeller 51 and the rear propeller 56. Thereby, an outboard motor that is low-noise while having a large propulsive force can be realized. By increasing the propulsive force of the outboard motor 1 as described above, the thrust load applied to the outboard motor 1 is increased when the hull moves forward or backward. However, the support structure of the propeller shafts 31 and 32 in the outboard motor 1 of the present embodiment has a structure in which the thrust load when the hull moves forward finally concentrates on the first bearing 41, and the thrust load when the hull moves rearward finally concentrates on the second bearing 42. Therefore, through a simple method of selecting bearings having a large size and a large allowable thrust load as the first bearing 41 and the second bearing 42, it is possible to secure durability that can sufficiently withstand an increased thrust load.

Further, in the outboard motor 1 of the present embodiment, the gear casing 15 is provided with the component insertion hole 22 through which the components in the gear chamber 16, such as the rear gear 34 and the second bearing 42, can pass, and the cover member 23 which covers the component insertion hole 22. The cover member 23 is provided with the propeller shaft insertion hole 24 into which the inner propeller shaft 31 and the outer propeller shaft 32 are inserted, and the bearing support portion 25 which supports the third bearing 43. The cover member 23 is detachably attached to the gear casing 15. According to this configuration, for example, after the rear propeller 56 is removed from the inner propeller shaft 31 and the front propeller 51 is removed from the outer propeller shaft 32, the outer propeller shaft 32, the rear gear 34, the second bearing 42, and the third bearing 43 can be removed from the gear casing 15 together with the cover member 23. Since the outboard motor 1 can be easily disassembled in this manner, it is possible to easily replace parts of the outboard motor 1 and the like.

For example, since the third bearing 43 supports the inner propeller shaft 31 and the outer propeller shaft 32 in a manner rotatable with respect to each other, the third bearing 43 rotates at a higher speed than the first bearing 41 or the second bearing 42 during operation of the outboard motor 1. Therefore, it is considered that a life of the third bearing 43 is shorter than that of the first bearing 41 or the second bearing 42, and that the third bearing 43 has a higher frequency of replacement. According to the present embodiment, as described above, since the third bearing 43 can be easily taken out of the gear chamber 16, the third bearing 43 can be easily replaced.

Further, according to the outboard motor 1 of the present embodiment, the inner propeller shaft 31, the outer propeller shaft 32, the front gear 33, the rear gear 34, the bearings 41 to 44, and the like can be incorporated into the gear chamber 16 from the rear of the gear casing 15. In this way, since the components in the gear chamber 16 can be incorporated into the gear casing 15 in the same direction, it is possible to easily manufacture the outboard motor 1.

Further, since the gear casing 15 in the present embodiment has a structure that is easy to be disassembled as described above, the gear casing 15 can be easily applied not only to a contra-rotating outboard motor having two propeller shafts and two propellers, but also to a single shaft type outboard motor having one propeller shaft and one propeller. For example, by replacing the propeller shaft and the propeller, it is possible to easily change the contra-rotating outboard motor to a single shaft type outboard motor.

In the above-described embodiment, a case where the size and the allowable thrust load of the first bearing 41 are larger than the size and the allowable thrust load of the second bearing 42 is described as an example, but the size and the allowable thrust load of the first bearing 41 may be the same as the size and the allowable thrust load of the second bearing 42. For example, two same bearings may be used as the first bearing 41 and the second bearing 42, respectively.

The electric motor 5 is used as the power source in the above embodiment, but an internal combustion engine may be used as the power source as well. In addition, an outboard motor is described as an example of the ship propulsion machine of the present invention in the above embodiment, but the present invention can also be applied to an inboard/outboard motor.

The present invention can be modified as appropriate without departing from the concept or spirit of the invention which can be read from the claims and the entire specification, and the ship propulsion machine to which such a change is applied is also included in the technical concept of the present invention.

What is claimed is:

1. A ship propulsion machine comprising:

a drive shaft extending in an upper-down direction and configured to rotate based on power of a power source;

a drive gear fixed to a lower end side of the drive shaft;

an inner propeller shaft extending in a front-back direction;

an outer propeller shaft formed in a tubular shape and arranged on an outer peripheral side of the inner propeller shaft in a manner coaxial with the inner propeller shaft;

a front gear fixed to a front end side of the inner propeller shaft and meshed with the drive gear at a position forward of the drive shaft;

a rear gear fixed to a front end side of the outer propeller shaft and meshed with the drive gear at a position rearward of the drive shaft;

a rear propeller provided on the inner propeller shaft;

a front propeller provided on the outer propeller shaft;

a casing having a gear chamber in which the lower end side of the drive shaft, the front end side of the inner propeller shaft, and the front end side of the outer propeller shaft are inserted, and in which the drive gear, the front gear, and the rear gear are accommodated;

a first bearing that rotatably supports the front end side of the inner propeller shaft at a front portion of the casing;

a second bearing that rotatably supports the front end side of the outer propeller shaft at a rear portion of the casing;

a third bearing that supports the inner propeller shaft and the outer propeller shaft in a manner rotatable with respect to each other; and a fourth bearing that supports the inner propeller shaft and the outer propeller shaft in a manner rotatable with respect to each other at a position rearward of the third bearing, wherein the third bearing is disposed on an inner peripheral side of a shaft portion of the rear gear, and the second bearing is disposed on an outer peripheral side of the shaft portion of the rear gear.

2. The ship propulsion machine according to claim 1, wherein the fourth bearing is a needle bearing.

3. The ship propulsion machine according to claim 1, wherein the inner propeller shaft is provided with a lubricating oil passage through which lubricating oil in the gear chamber is to be supplied to the fourth bearing.

4. The ship propulsion machine according to claim 1, wherein a size of each of the first bearing and the second bearing is larger than a size of each of the third bearing and the fourth bearing.

5. The ship propulsion machine according to claim 1, further comprising:

a component insertion hole provided in the rear portion of the casing, having a diameter larger than an outer diameter of each of the front end side of the inner propeller shaft, the front end side of the outer propeller shaft, the rear gear, the second bearing, and the third bearing, and allowing an outside of the casing and the gear chamber to communicate with each other; and a cover member detachably attached to the rear portion of the casing and covering the component insertion hole, wherein the cover member includes:

a propeller shaft insertion hole into which the inner propeller shaft and the outer propeller shaft are inserted, and a bearing support portion that supports the second bearing.

* * * * *